United States Patent [19]

Seitz

[11] Patent Number: 4,788,803

[45] Date of Patent: Dec. 6, 1988

[54] MODULAR INSULATED BUILDING STRUCTURE AND METHOD

[76] Inventor: John A. Seitz, N26W30249 Maple Ave., Pewaukee, Wis. 53072

[21] Appl. No.: 6,466

[22] Filed: Jan. 23, 1987

[51] Int. Cl.[4] ..... E04B 1/32

[52] U.S. Cl. ..... 52/82; 52/248; 52/741; 52/309.12

[58] Field of Search ..... 52/82, 224, 248, 741

[56] References Cited

U.S. PATENT DOCUMENTS

| | | | |
|---|---|---|---|
| 1,215,983 | 2/1917 | Peterson | 52/248 X |
| 2,649,625 | 8/1953 | Johnson | 52/248 X |
| 2,731,374 | 1/1956 | DeReus . | |
| 3,118,186 | 1/1964 | Moss . | |
| 3,119,153 | 1/1964 | Martin | 52/82 |
| 3,277,219 | 10/1966 | Turner . | |
| 3,763,608 | 10/1973 | Chamlee . | |
| 3,778,528 | 12/1973 | Heifetz et al. . | |
| 3,827,200 | 8/1974 | Preissler | 52/82 |
| 3,835,602 | 9/1974 | Tuuri | 52/82 |
| 4,022,644 | 5/1977 | Smith, Jr. . | |
| 4,094,110 | 6/1978 | Dickens et al. . | |
| 4,155,967 | 5/1979 | South et al. . | |
| 4,241,555 | 12/1980 | Dickens et al. . | |
| 4,324,074 | 4/1982 | South et al. . | |

*Primary Examiner*—Carl D. Friedman

*Attorney, Agent, or Firm*—Andrus, Sceales, Starke & Sawall

[57] ABSTRACT

A building structure includes an upstanding substantially vertical wall portion constructed from a plurality of interlocking wall sections and forming a closed shape. The wall sections are formed from a thermally insulating material. A retainer band is provided for placement about the periphery of the wall portion, and is adapted to be tensioned to maintain the wall portion in its closed shape. The exterior surface of the wall portion is coated with a concrete-like material, or any other satisfactory weather resistant coating material, to protect the insulating material of the wall sections from weather. A roof structure is adapted to be placed atop the wall portion. In one embodiment, the wall portion is circular in plan, and the roof structure comprises a plurality of wedge-shaped sections, with the base portion of the wedge sections adapted for placement atop the wall portion. The retainer band overlaps the base portion of the wedge sections and interlocks the roof and the wall portion. The roof sections are also constructed of an insulating material, and are coated with a weather resistant material after installation to protect the roof sections from weather.

10 Claims, 2 Drawing Sheets

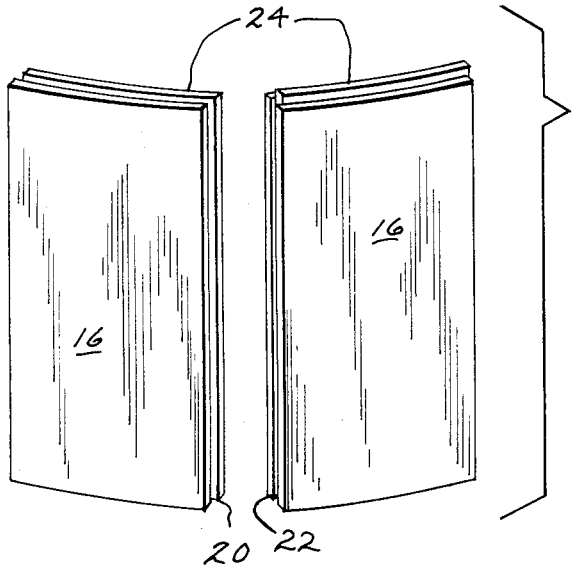
FIG. 2
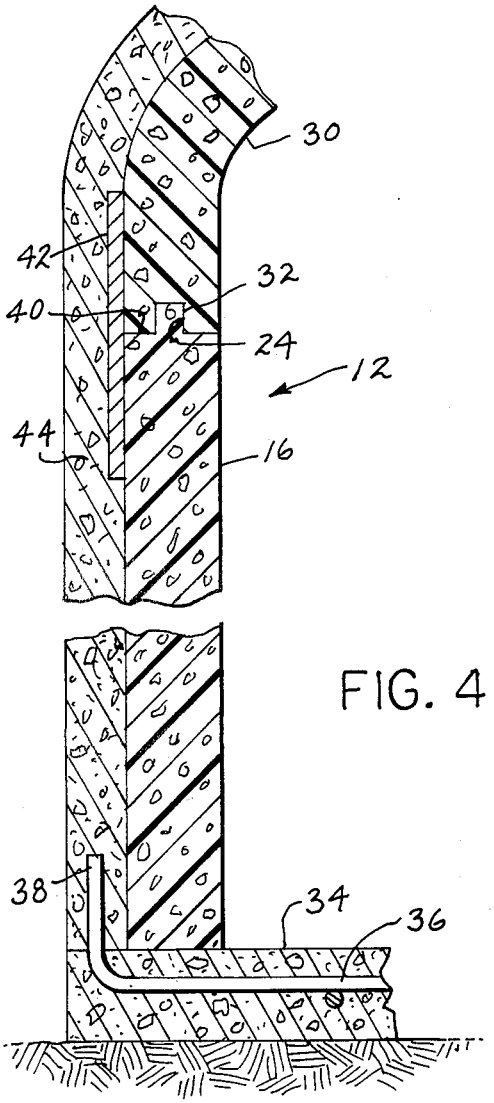
FIG. 4
FIG. 5
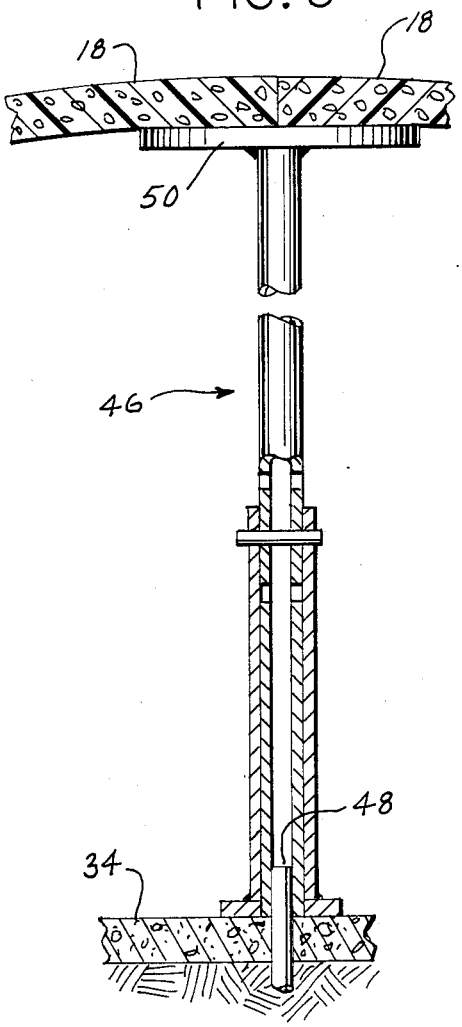

MODULAR INSULATED BUILDING STRUCTURE AND METHOD

BACKGROUND AND SUMMARY

This invention relates to a building structure and a method of constructing the same.

There is a need for a low cost building structure which is easily and quickly erectable, such as for residential applications. There is further a need for a building structure having a minimal amount of cracks or seams for reducing or eliminating heat loss or gain by convection. A need also exists for a sound and sturdy building structure which is well insulated so as to reduce heat loss or gain by conductivity. The present invention is addressed to these needs. In accordance with the invention, a wall portion of the building structure is constructed of a series of upstanding interlocking members made of a rigid insulating material, such as expanded polystyrene, foam plastic or the like. The upstanding wall sections are interlocked and placed on a slab of concrete or the like, preferably formed according to the final shape of the building structure. In one embodiment, the wall sections interlock by means of tongue and groove type joint. Architectual components, such as doors and windows, are preferably preformed into the insulating wall sections. A roof is placed atop the upstanding wall after the wall sections have been assembled. In one embodiment, the wall is circular in plan and the roof sections are interlocking wedge shaped members, also formed from a rigid insulating material. The base portion of each wedge shaped roof section rests on the wall and the apex of each roof section rests on a support provided substantially at the center of the building. After placement and interlocking of the roof sections, a band or strap is wrapped around the building structure. The band or strap may overlap the joint between the wall sections and the roof sections. Tension is introduced into the band to provide a secure and rigid building structure. After the roof and wall sections of insulating material are erected, the exterior surfaces of the roof and wall sections are coated with a concrete or other cementitious coating to protect the structure from ultraviolet rays, forced entry or the like, and to provide a permanent structure. Reinforcing bars, wire, or mesh may be bent upwardly from the floor slab outwardly of the wall sections, and the reinforcing bars may be covered with the cementitious material to provide a rigid integral structure. A method of constructing such a building structure is also disclosed.

BRIEF DESCRIPTION OF THE DRAWINGS

The drawings illustrate the best mode presently contemplated of carrying out the invention.

In the drawings:

FIG. 2 is an isometric view showing a pair of the upstanding interlocking wall sections;

FIG. 4 is a section view taken generally along line 4—4 of FIG. 1; and

FIG. 5 is an elevation view of a support post for supporting the roof sections at the center of the building structure during construction.

DETAILED DESCRIPTION OF THE PREFERRED EMBODIMENT

Figure 1:
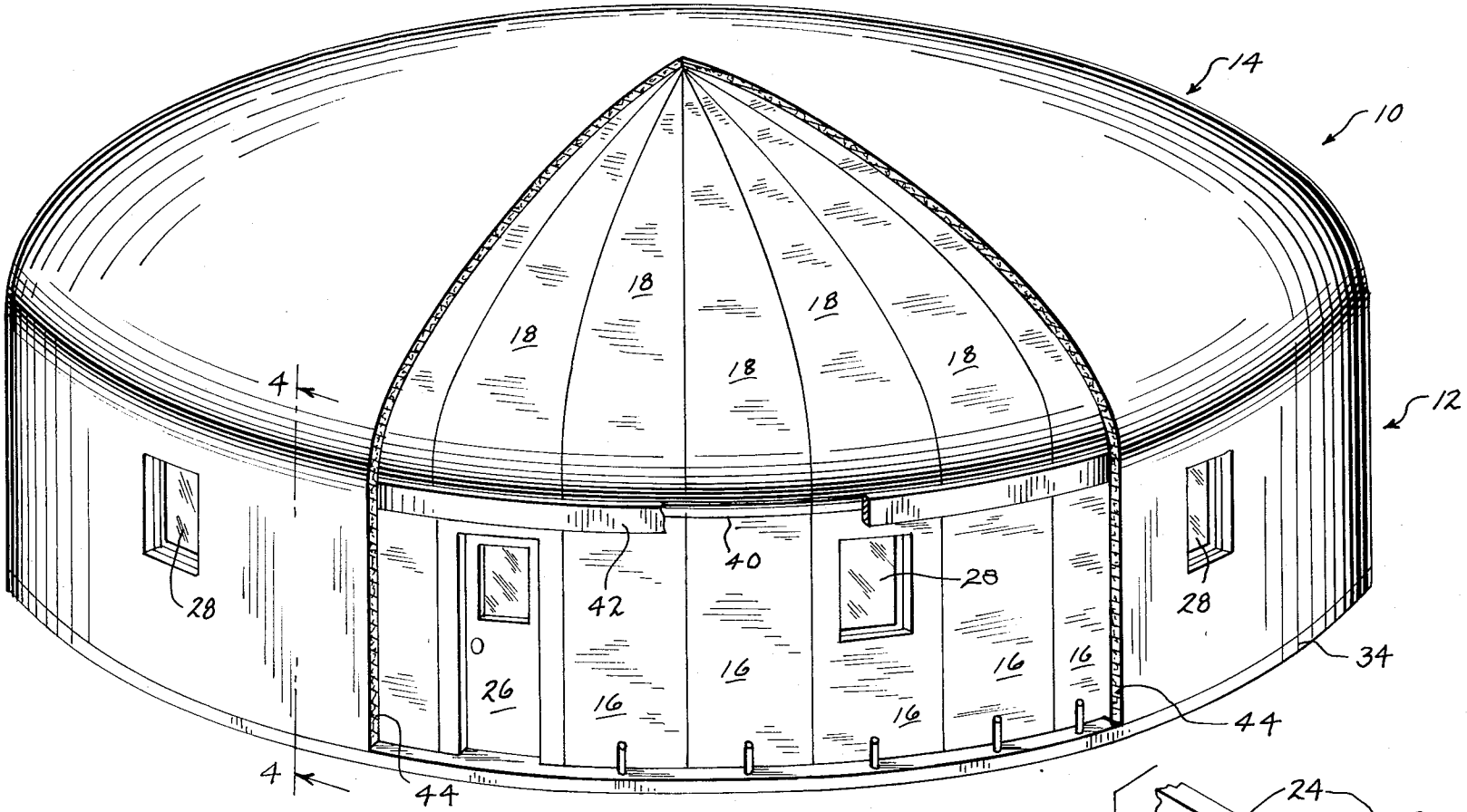
FIG. 1 is an isometric view of the building structure according to the present invention, with portions broken away for clarity.
Figure 3:
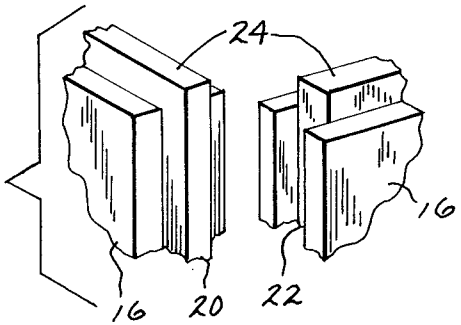
FIG. 3 is a close-up isometric view of the interlocking tongue and groove joint provided on the wall sections.

With reference to FIG. 1, a building structure 10 generally includes a wall portion 12 and a roof portion 14. Wall portion 12 is constructed of a plurality of interlocking wall sections 16, and roof portion 14 is constructed from a plurality of interlocking roof sections 18. As shown in FIG. 1, building structure 10 is substantially circular in plan.

With reference to FIG. 2, wall sections 16 are interlocking one with another. As shown, the rightward edge of each wall section 16 is provided with a longitudinal tongue 20 extending along its height, and the leftward edge of each wall section 16 is provided with a groove 22 extending along its height. The wall sections 16 interlock by mating tongue 20 with groove 22. A bead of adhesive, caulking or tape may be placed between the wall sections 16 to temporarily hold the sections together.

Each wall section is slightly curved in plane, so that interlocking a plurality of wall sections 16 results in a circular wall. With further reference to FIG. 2, each wall section 16 is provided with a tongue 24 extending along its upper edge.

With reference again to FIG. 1, architectural components, such as a door 26 and one or more windows 28, are pre-formed into wall sections 16. That is, the door 26 or the windows 28 are preferably factory installed and disposed in the wall sections 16 upon their delivery to the construction site. In this manner, site location and placement of doors and windows or other architectural components is unnecessary. Alternatively, such architectural components may be field installed by forming appropriate openings in wall sections 16 and installing such components therein.

The factory formed modular wall sections 16 provide rapid erection of wall portion 12 on the site. The wall sections 16 are simply "plugged" together, and facilitate rapid alignment to ensure the correct final configuration of wall portion 12.

Again referring to FIG. 1, roof sections 18 are substantially wedge-shaped in plan. Each roof section 18 has a pair of diverging side portions extending between an apex and a base portion. The base portion of each roof section is adapted to rest atop and be supported by wall portion 12. As seen in FIG. 4, roof sections 18 include a downwardly curved portion 30, so that the base portion of each roof section 18 extends substantially parallel to upstanding wall portion 12. Each roof section 18 is provided at its base portion with a groove 32 adapted to mate with upstanding tongue 24 provided about the periphery of wall portion 12 on each wall section 16.

Wall sections 16 and roof sections 18 are preferably constructed of a rigid insulating material, such as expanded polystyrene or the like. Alternatively, a molded corrugated cardboard or a foamed plastic or cement material may be used, as long as it is sufficiently rigid and provides adequate insulating properties.

Referring to FIG. 4, a circular concrete slab 34 having a configuration substantially corresponding to the finished building structure, is formed on site prior to construction of building structure 10. A plurality of reinforcing bars 36 are provided in concrete slab 34. A wire mesh may also be used to reinforce slab 34, as a replacement for or in combination with reinforcing bars 36. Reinforcing bars or mesh 36 include an upwardly curved portion 38 which extends from the upper surface of slab 34 outwardly of the exterior surface of wall portion 12 of building structure 10. A bead of caulking, mortar or the like may be provided between slab 34 and the lower edge of wall portion 12 to create an air and water tight seal therebetween.

After wall sections 16 and roof sections 18 have been assembled by interlocking their respective tongue and groove portions and roof portion 14 is in place atop wall portion 12 to thereby form a joint 40 therebetween, a band or strap 42 is provided about the exterior periphery of building structure 10 so as to overlap joint 40. Tension is introduced into strap 42 after placement over joint 40 by any satisfactory means, to provide a rigid foam structure.

Band or strap 42 may be constructed of any suitable material capable of withstanding a certain amount of tension, such as of a fibrous material, reinforced tape or wire rope, fiberglass or continuous filament. A steel tape or a flexible flat steel stock may also be used.

After belt 40 has been adequately tensioned, the exterior surface of wall portion 12 and roof portion 14 is coated with a concrete or other cementitious material, denoted at 44. Alternatively, layer 44 may be any satisfactory non-cementitious weather resistant material. Concrete layer 44 is preferably sprayed into place, but may be troweled if certain surface effects are desired. Layer 44 may be any satisfactory material such as concrete, plaster or stucco. Layer 44 provides a watertight and weather resistant seal for protecting the insulating material forming wall portion 12 and roof portion 14. As shown in FIG. 4, the concrete layer 44 encases the upstanding portion 38 of reinforcing bars 36, to prevent outward movement or lifting of the lower portions of wall portion 12 and to form an integral building structure. Concrete layer 44 may be reinforced as necessary to provide adequate structural integrity. If necessary, the exterior surface of wall portion 12 and roof portion 14 may be mechanically or chemically scored to provide suitable adhesion of concrete layer 44 thereto. Alternatively, a wire mesh may be provided for adequate surface adhesion.

Although not shown, the interior surface of wall portion 12 and roof portion 14 may also be covered with any satisfactory material, as desired.

The shape and construction of roof portion 14 is particularly desirable due to its ability to withstand vertical loads. Such loads place the cementitious layer 44 on roof portion 14 in a compression mode, in which it can withstand the greatest stresses.

With reference to FIG. 5, an adjustable height post 46 is located over a central pin 48 provided in slab 34 at the center point of building structure 10. Post 46 acts as an aid in construction of the roof portion 14, and is provided at its uper end with a plate 50 adapted to receive the innermost ends of roof sections 18 during construction of building structure 10. Adjustable height post 46 assures placement of roof sections 18 at the proper elevation during construction. Thereafter, the tension provided by belt 42 will maintain roof sections 18 in place, and post 46 can be removed.

Utilities such as plumbing or electrical conduits and/or wiring can be placed in wall portion 12 simply by cutting or routing a U-shaped trough into the surface thereof. A template may be used to facilitate placement of such utilities. Boxes, conduits, piping or wiring can be inserted into the U-shaped trough with finger pressure. Thereafter, the troughs can be filled with grout to smooth the surface in preparation for finishing.

Alternatively, plumbing and/or electric trees may be pre-assembled, either in the field or shop, and installed in the building structure 10 with the aid of templates or the like to facilitate rapid placement.

While the invention has been described with reference to a circular building structure, it is recognized that the invention is useful with other building shapes. For example, with a rectangular structure, apron beams located at the joint between the roof and wall can be attached to each other at the corners, or interconnecting bars or cables piercing the building can be connected to opposing apron beams. This construction permits the use of a rectangular shaped building and/or a peak or hipped roof. Additionally, rectangular or irregularly shaped buildings may be constructed utilizing conventional truss construction or a conventional flat roof.

The above discussed building construction provides a building structure which is easily and quickly erected, and which is relatively low in cost. The building construction is efficient in that the roof and wall sections are formed of an insulating material which provides a form or support for the concrete outer layer of the building and which remains in place to insulate the building. The wall and roof sections provide a well insulated structure having a built-in vapor barrier.

The building structure of the present invention may also be used as a temporary structure. In such a case, the wall and roof sections may be erected over a staked-down ground barrier, such as a canvas sheet. A dome shaped sheet of canvas or other fabric is then installed over the roof and wall portions and secured either to the ground or to the canvas ground sheet. The dome shaped sheet protects the insulative material from the harmful effects of ultraviolet rays.

Various alternatives and modifications are contemplated as being within the scope of the following claims particularly pointing out and distinctly claiming the subject matter regarded as the invention.

I claim:

1. A building structure, comprising:

an upstanding substantially vertical wall portion constructed from a plurality of interlocking thermally insulating rigid foam wall sections, said wall portion forming a closed shape;

a roof portion adapted for placement atop said wall portion for enclosing said building structure, said roof portion being constructed from a plurality of interlocking thermally insulating rigid foam roof sections, said roof sections having a substantially vertical end portion adapted for placement adjacent the upper end of said wall portion so as to form a joint therebetween;

retainer means comprising a band adapted to overlap the joint between said roof sections and said wall sections about the periphery of said building structure, and adapted to be tensioned to maintain said structure in said closed shape; and a cementitious weather resistant coating applied to the exterior surface of said wall and roof portions for protecting the rigid foam insulating material thereof.

2. The building structure according to claim 1, wherein said rigid foam wall sections interlock by means of mating tongue and groove means formed integrally with said wall sections.

3. The building structure according to claim 1, wherein said wall portion is substantially circular in plan.

4. The building structure according to claim 3, wherein said interlocking rigid foam roof sections are substantially wedge shaped, each said roof section having a pair of diverging side portions extending between an apex and a base portion, said base portion being provided with said substantially vertical end portion adapted for placement adjacent the upper end of said wall portion.

5. The building structure according to claim 4, wherein said substantially vertical end portion of said roof sections and the top of said wall are provided with interlocking means for connecting said roof sections to said wall.

6. The building structure according to claim 5, wherein said interlocking means comprises mating tongue and groove means.

7. The building structure according to claim 1, wherein architectural components such as doors, windows or the like are preformed in said rigid foam wall sections prior to assembly thereof to form said wall portion.

8. The building structure according to claim 1, wherein said building structure is constructed on a preformed slab of concrete-like material, and wherein said preformed slab is provided with reinforcing means adjacent at least a portion of the exterior surface of said wall and said cementitious coating is applied over said reinforcing means.

9. A building structure, comprising:

an upstanding substantially vertical wall portion constructed from a plurality of interlocking wall sections formed from a thermally insulating rigid foam material, said wall portion forming a closed substantially circular shape, said wall sections being provided with architectural components such as doors, windows or the like prior to erection of said wall portion;

a roof portion constructed from a plurality of interlocking thermally insulating rigid foam roof sections, said roof sections being substantially wedge shaped and having a pair of diverging side portions extending between an apex and a base portion, said base portion forming a substantially vertical end portion adapted for placement adjacent the upper end of said wall portion so as to form a joint therebetween;

band means adapted to overlap the joint between said roof sections and said wall portion and extending about the periphery of said building structure adjacent the outer surface thereof and adapted to be tensioned thereabout to maintain the circular shape of said structure; and a concrete-like coating applied to the outer surface of said roof and wall portions for protecting the rigid foam insulating material of said roof and wall sections.

10. A method of constructing a building structure, comprising the steps of:

providing a plurality of interlocking wall sections formed from a thermally insulating rigid foam material;

interlocking said wall sections to form a closed shape;

providing a plurality of interlocking roof sections formed from a thermally insulating rigid foam material, each said roof section having a substantially vertical end portion;

placing said roof sections atop said interlocked wall sections so that the substantially vertical end portion of said roof sections is adjacent the upper end of said wall sections so as to form a joint between said roof sections and said wall sections;

providing a retainer band overlapping the joint between said roof sections and said wall sections about the outer periphery of said building structure;

introducing tension to said retainer band to maintain said closed shape of said structure; and coating the outer surfaces of said wall and roof sections with a weather resistant cementitious material.

* * * * *